US009074598B2

(12) United States Patent
Shaffer et al.

(10) Patent No.: US 9,074,598 B2
(45) Date of Patent: Jul. 7, 2015

(54) SCROLL TYPE DEVICE INCLUDING COMPRESSOR AND EXPANDER FUNCTIONS IN A SINGLE SCROLL PLATE PAIR

(75) Inventors: Robert W. Shaffer, Broomfield, CO (US); Bryce R. Shaffer, Broomfield, CO (US)

(73) Assignee: Air Squared Manufacturing, Inc., Broomfield, CO (US)

( * ) Notice: Subject to any disclaimer, the term of this patent is extended or adjusted under 35 U.S.C. 154(b) by 156 days.

(21) Appl. No.: 13/507,779

(22) Filed: Jul. 30, 2012

(65) Prior Publication Data

US 2013/0036762 A1 Feb. 14, 2013

Related U.S. Application Data

(60) Provisional application No. 61/574,771, filed on Aug. 9, 2011.

(51) Int. Cl.

| | |
|---|---|
| ***F04C 2/00*** | (2006.01) |
| ***F04C 18/02*** | (2006.01) |
| ***F25B 1/04*** | (2006.01) |
| ***F25B 11/02*** | (2006.01) |
| ***F01C 1/02*** | (2006.01) |

(52) U.S. Cl.

CPC ..... *F04C 18/0215* (2013.01); *F25B 1/04* (2013.01); *F25B 11/02* (2013.01); *F04C 18/0269* (2013.01); *F01C 1/0215* (2013.01); *F01C 1/0269* (2013.01)

(58) Field of Classification Search

CPC .... F01C 1/0223; F01C 1/0246; F01C 11/004; F25B 1/04; F25B 11/02; F04C 18/0215; F04C 23/001; F04C 23/0003; F04C 18/0269; F01K 25/08; F02G 5/00; F02G 5/04; Y02E 20/18

USPC ..... 418/182, 55.2, 55.1, 55.5, 151; 60/670, 60/671, 651

See application file for complete search history.

(56) References Cited

U.S. PATENT DOCUMENTS

| | | | | |
|---|---|---|---|---|
| 5,466,134 | A * | 11/1995 | Shaffer et al. | 418/55.1 |
| 6,050,792 | A | 4/2000 | Shaffer | |
| 6,129,530 | A | 10/2000 | Shaffer | |
| 6,434,943 | B1 | 8/2002 | Garris | |
| 6,439,864 | B1 * | 8/2002 | Shaffer | 418/55.2 |
| 6,511,308 | B2 * | 1/2003 | Shaffer | 418/55.6 |
| 6,922,999 | B2 * | 8/2005 | Kimura et al. | 418/55.1 |
| 7,942,655 | B2 * | 5/2011 | Shaffer | 418/55.1 |
| 2010/0254835 | A1 * | 10/2010 | Kane et al. | 418/55.1 |

* cited by examiner

*Primary Examiner* — Thomas Denion
*Assistant Examiner* — Thomas Olszewski
(74) *Attorney, Agent, or Firm* — Paul M. Denk

(57) ABSTRACT

A scroll type device for operating on a fluid provided thereto that includes, as a unit, a housing with two interleaved scroll plates that are installed within such housing and that are operably movable relative to one another in an eccentric orbit, with such scroll plates including interleaved spiral projections, spiral projections include first and second portions, which portions will operate for expansion and the other of which portion will operate for compression as the unit operates in a given normal direction of movement.

8 Claims, 4 Drawing Sheets

SCROLL TYPE DEVICE INCLUDING COMPRESSOR AND EXPANDER FUNCTIONS IN A SINGLE SCROLL PLATE PAIR

CROSS REFERENCE TO RELATED APPLICATION

This non-provisional patent application claims priority to the provisional patent application having Ser. No. 61/574,771, filed on Aug. 9, 2011.

FIELD OF THE INVENTION

This invention relates generally to scroll type devices and to a novel design therefore that incorporates into a single scroll type unit both compressor and expander functions for use as the unit operates in a given normal direction of operation, with both the compressor and expander functions being effected by the eccentric orbiting of the same pair of scroll plates relative to one another.

BACKGROUND OF THE INVENTION

Over the years compressors and expanders of many and various types have been found to have many uses, including for heat transfer purposes, and compressors and expanders of various types and designs have been developed for use therein or therewith.

In more recent years, the use of scroll type compressors has become common. Such scroll type compressors typically employ two interleaving scrolls that often, but not exclusively, employ involute vane geometries to pump, compress, or pressurize the fluids, such as liquids or gases, with such liquids or gases typically being introduced into the scroll type device through an inlet or input port and discharged through a discharge port.

Often, one of the scrolls is held fixed while the other scroll orbits eccentrically, without rotating, to trap and pump or compress pockets of fluid between the scrolls, although other techniques for effecting suitable relative motion between the scrolls for such result can also be utilized, including co-rotating the scrolls, in synchronous motion.

Such scroll type devices generally tend to be compact and to operate more smoothly, quietly, and reliably than previous types of compressors.

Typically, such scroll compressors are designed and intended to operate during normal operation in one direction, herein generally referred to as the normal or forward direction, in order to function properly within the systems where they are employed. With some of such scroll compressors, some limited reverse operation, although generally considered undesirable, may be permitted or tolerated, such as to mitigate flooded operation of the compressor at start up, but the overall operation is as a compressor operating in a forward direction. When so operated, such devices effect compression of the fluids introduced thereinto. One common use of such scroll compressors has been in air conditioning systems, whether for heating or cooling.

Some other scroll type devices of a somewhat similar design, though with different connected porting, and with a differently configured involute or with a similar involute configured to eccentrically orbit differently than as a scroll compressor, have more recently been developed, with such devices intended, when properly configured and ported in a system, to serve an expansion function instead of a compression function. At least some of such scroll type devices typically employ scroll plates highly similar to the scroll plates of the previously referenced scroll compressors, with generally like interleaved involute wraps thereon, but such scroll type devices are designed to be normally operable in a direction that is the reverse direction from that of such previously referenced scroll compressors. Such scroll type devices are sometimes referred to as scroll expanders. One use of such scroll expanders has been for standby and Uninterruptible Power (UPS) applications wherein a compressed air battery uses air to drive a scroll expander which in turn drives a conventional generator to produce electricity.

In the past, such single stage scroll type devices, with their single pair of scroll plates, whether intended to effect a compression or an expansion function, have generally been designed or intended to be normally operable in only one direction within the systems in which they are employed, and to function during their normal operation as either a scroll compressor or a scroll expander, and not as both a scroll compressor and scroll expander.

In general, scroll type compressors have been limited to a single stage of compression due to the complexity and difficulties associated with two or more stages. However, some recent scroll type devices have been designed to include multiple stages, some with multiple pairs of interacting scroll plates, to achieve more desirable performance and results. Some more recent scroll type compressors, such as those disclosed in U.S. Pat. Nos. 6,050,792 and 6,439,864, include multiple stages, with appropriate associated fluid ports, within a single scroll type compressor. Such scroll type devices are not operable to effect both compression and expansion functions by the operation of a single pair of scroll plates in a normal direction, however, and some require multiple pairs of scroll plates to realize the multiple stages.

Another recent scroll type device of interest is the invention, by the inventor of the present invention, disclosed in U.S. patent application Ser. No. 13/066,261. That invention is a scroll type construction that employs a plurality of fixed and orbiting scrolls arranged to operate as a three stage vacuum pump wherein the first stage acts upon working fluid provided at an inlet as a compressor, the second stage acts upon working fluid from the first stage as an expander, and the third stage acts upon working fluid from the second stage as a compressor, all as the scroll type device operates in a normal forward direction. While such scroll type device effects both compression and expansion within the single, multi-stage unit, wherein the compression and expansion operations are part of a single, desired operation, with the output of one stage feeding the input of the succeeding stage, the overall effect of such unit's operation is that of a vacuum pump. Moreover, such multi-stage operations require multiple fixed and orbiting scrolls in order to affect the staged, linear expansion and compression functions realizable therewith; both compression and expansion functions are not realizable in any single stage of the unit from the use of a single pair of scroll plates.

Consequently, even though the construction of U.S. patent application Ser. No. 13/066,261 has been designed to incorporate within a single scroll type device both compression and expansion functions, such functions have formed constituent parts of an overall compression operation, and the compression and expansion functions have not been available for separate and/or independent use and, in any event, are not effected by the normal operation of a single pair of scroll plates in a forward direction. In order to realize the staged compression and expansion functions of such construction, multiple pairs of scroll plates are required to be configured in particular manners. Consequently, even with such construction, realization of both compression and expansion functions from a single pair of scroll plates in a single scroll type device has not been possible.

Against such backdrop, it has also been recognized for many years that many waste heat energy sources, such as solar, engine exhaust, geothermal, and other sources that employ processes where the waste heat is exhausted to the atmosphere, currently exist, and that it would be advantageous and desirable if the energy in such waste heat sources could be recovered for beneficial uses, including for air conditioning purposes. Effective realization of such an objective has remained problematic, however.

It has been recognized by the inventors of the invention hereinafter described that, in order to capture and advantageously make use of the waste heat of such previously noted energy sources, particularly for air conditioning purposes, an expander can be utilized in an Organic Rankine Cycle (ORC) to generate power, and that the power from the Organic Rankine Cycle expander can then be used to power a compressor for a traditional vapor compression cycle for air conditioning, either heating or cooling. It has been further observed, however, that it is inefficient and costly to have to utilize separate expanders and compressors for such purpose.

To address such desires and the shortcomings and limitations associated with having to employ separate expanders and compressors, a novel scroll type device including compressor and expander functions through the use of a single pair of scroll plates in a single unit has therefore been developed.

SUMMARY OF THE INVENTION

The present invention offers a significant advance over prior art constructions in that it is a scroll type construction or unit of a unique design that realizes both compression and expansion functions from the operation of a single pair of scroll plates as the unit normally operates in a single, normal direction. Such design eliminates any gearing or shafting between the compressor and expander, and, at the same time, reduces cost and increases efficiency.

Such construction includes a housing with two interleaved scroll plates that form a scroll plate pair and which are installed within such housing to be operably movable relative to one another, such as in an eccentric orbit relative to one another. Preferably, one of such scroll plates is fixed and the other scroll plate is movable, and such scroll plates include interleaved spiral projections on facing sides thereof, each of which spiral projections includes first and second portions, with the first spiral portion forming an inner involute spiral or wrap that spirals outwardly from the center in one spiral direction to an intermediate spiral point located intermediately between the center and the outer limit of the scroll plate and a second spiral portion forming an outer involute spiral or wrap that spirals outwardly from the intermediate spiral point in the opposite, or counter, direction from that of the inner involute spiral to an outer spiral point near the outer limit of the scroll plate.

Preferably, the inner portions of the scroll plates will operate for expansion and the outer portions will operate for compression, but such portions and functions may be reversed if desirable for certain conditions or circumstances.

For such noted, preferred operation of the inner and outer portions of the scroll plates, an expander inlet is provided at the center, a compressor inlet is provided at the outer spiral point, and a compressor discharge and expander discharge is provided at the intermediate spiral point.

As the device operates in its normal, forward direction, the inner portion operates as an expander to expand the working fluid provided thereto at the expander inlet port associated with the center of the involute scrolls and to discharge the expanded fluid at the discharge port at the intermediate spiral point, and the outer portion operates as a compressor to compress the working fluid provided thereto at the compressor inlet port at the outer spiral point and to discharge the compresses fluid at the discharge port at the intermediate spiral point.

As preferably used for air conditioning purposes as part of a waste heat air conditioning system, the expander portion is thus operable to generate power that can be used to drive the compressor portion. Heated high pressure refrigerant will enter the expander portion and, during the expansion process, will produce power to drive the compressor, which will then compress refrigerant for a traditional air conditioning cycle.

Typically, the expander inlet port will be connected to the outlet from the evaporator of an ORC, the compressor inlet port will be connected to the outlet from the evaporator of the traditional air conditioning cycle, and the discharge port will be at an intermediate pressure, with part of the flow therefrom going to the condenser for the ORC and part going to the condenser of the air conditioning system.

DESCRIPTION OF THE PREFERRED EMBODIMENT

Figure 1:
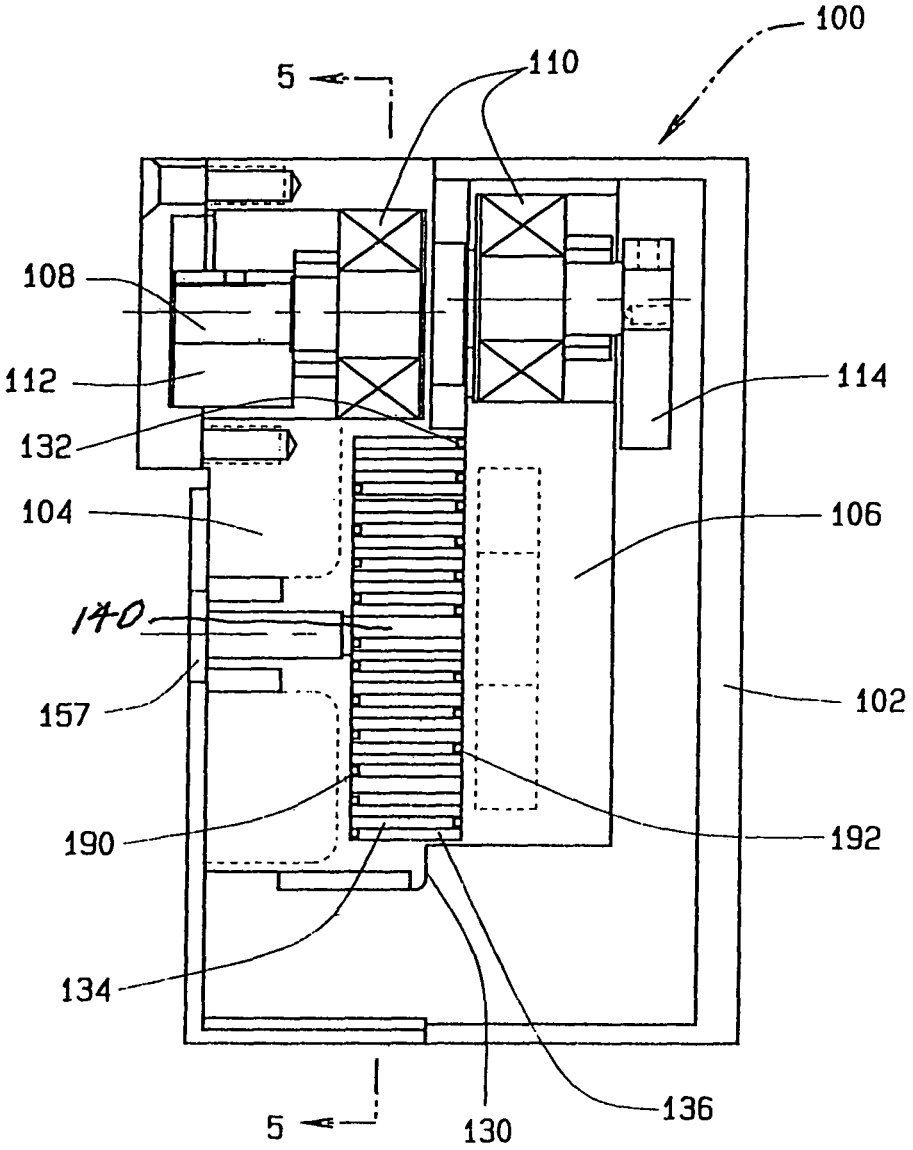
FIG. 1 is a cross section of a single scroll type unit constructed according to the present invention and in which idler shafts are shown employed for taking the axial loads and for controlling the motion and clearance between the scrolls of such unit.

Referring now to the drawings where like numbers refer to generally like items, FIG. 1 depicts a preferred scroll type device 100 constructed according the present invention and including a housing 102, which seals the unit from the atmosphere, with a fixed scroll plate 104 and an orbiting scroll plate 106 mounted therein on three generally equilaterally spaced idler shafts 108 rotatable within associated bearings 110. Counterweights 112 and 114 are shown disposed about and fastened to the idler shafts 108 so that the eccentric weight of the orbiting scroll plate 106 remains balanced o and to reduce vibration during operation. Such support constructions are designed to take the axial loads and to control the motion of and clearance between scroll plates 104 and 106 as they move relative to one another.

A typical design and description of operation of idler shafts such as idler shafts 108 is provided in U.S. Pat. No. 6,129,530, which is incorporated herein by reference thereto. Other idler shafts of known or similar or other constructions that can also act to take the axial loads and to control the motion of and clearance between scroll plates 104 and 106 could be equally as well employed.

Such idler shafts 108 are preferably spaced approximately 120° from each other around the outside of the scroll plates 104 and 106. Although such idler shafts 108 are shown located between fixed scroll plate 104 and orbiting scroll plate 106, they could just as easily be located between the orbiting scroll plate 106 and the housing 102.

Figure 2:
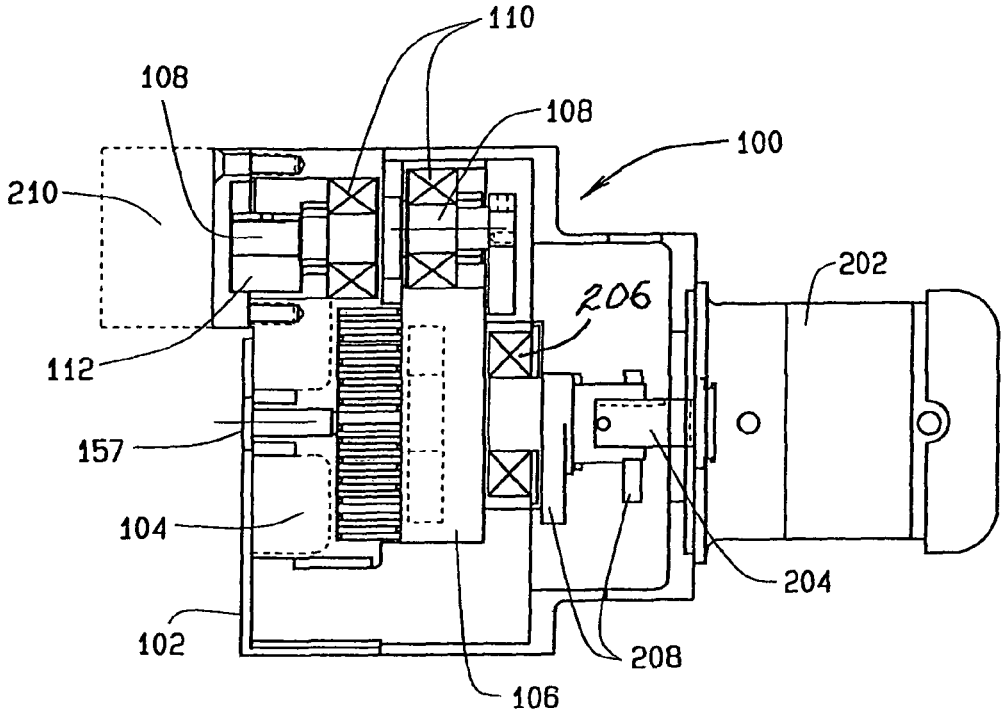
FIG. 2 is a cross section of an alternative single scroll type unit similar to FIG. 1, but which also includes an optional auxiliary motor for driving the unit as it is operating as a compressor when waste heat is not available.
Figure 3:
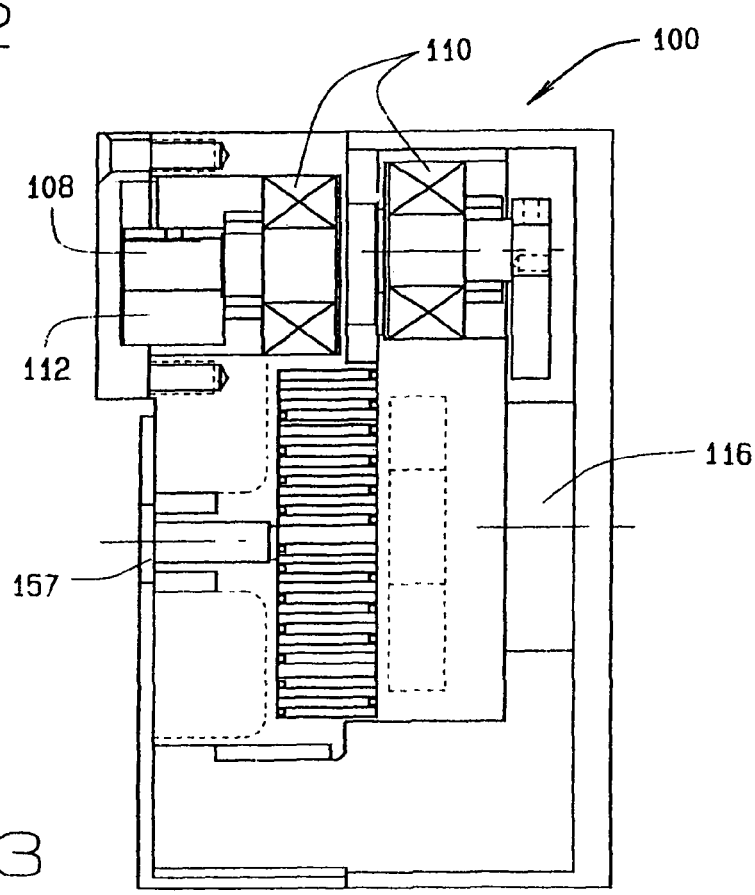
FIG. 3 is a cross section of another alternative single scroll type unit similar to FIG. 1, but which employs a flat plate thrust bearing for taking the axial loads, which reduces the loads on the idler shaft bearings allowing them to be smaller and making the unit smaller and lower cost.

FIGS. 2-3 depict alternative embodiments of scroll type units that employ like support constructions but which also include other optional elements, such as the flat thrust bearing 116 of FIG. 3 that is provided in order to reduce and to effect minimal loading on the idler shaft bearings 110. With the use of such flat thrust bearing 116, the idler shaft bearings 110 are more lightly loaded. Such lighter loading permits the use of smaller idler shaft bearings 110, thereby saving space and weight, and thus also allows the overall scroll type unit to be smaller and less costly.

Figure 4:
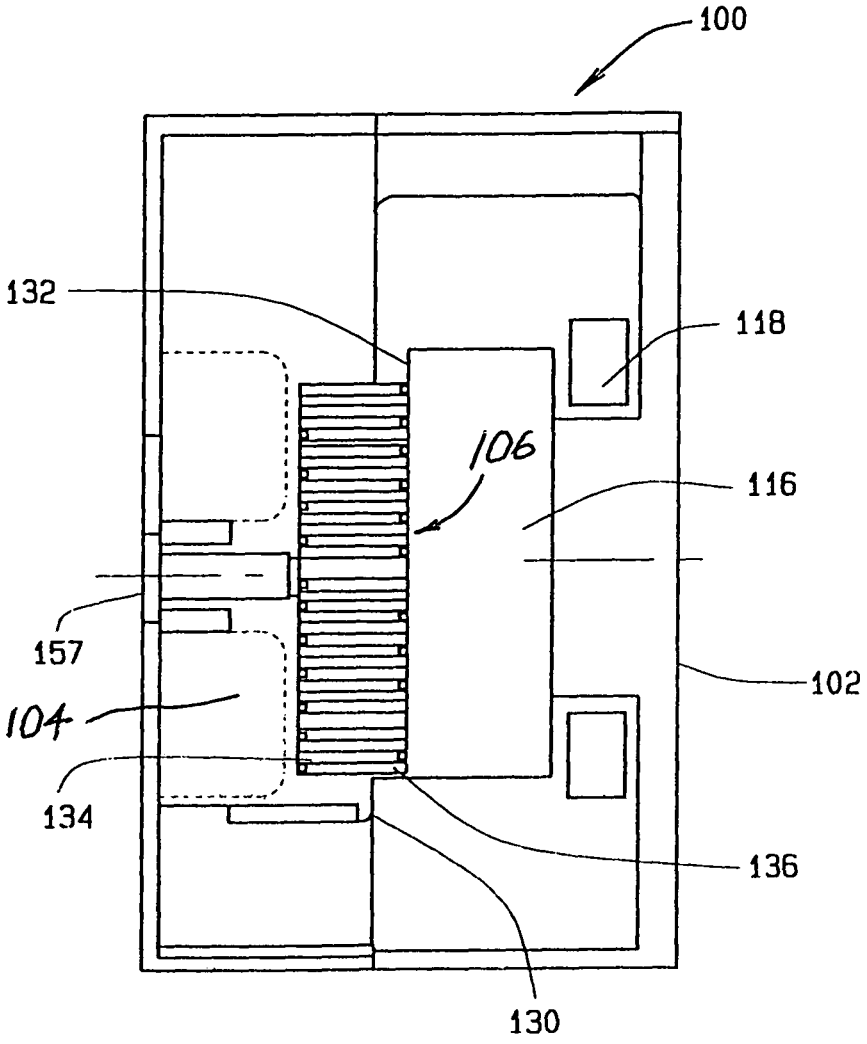
FIG. 4 is a cross section of another alternative single scroll type unit constructed according to present invention that, instead of idler shafts, employs an Oldham ring for aligning the scrolls and a flat plate thrust bearing for taking the axial loads.

Those skilled in the art will recognize and understand that alternatives other than idler shafts and associated bearing constructions can also be effectively utilized to properly align and control the scroll plates during their movement relative to one another. FIG. 4 depicts one suitable alternative construction for accomplishing such alignment and control, and shows a scroll type unit 100 in which the positioning and alignment of the fixed scroll plate 104 and the orbiting scroll plate 106 are maintained through the use of an Oldham ring construction 118 instead of the idler shafts and associated bearing constructions of FIGS. 1-3.

As will thus be further recognized and understood by those skilled in the art, the particular manner of effecting such alignment and positioning of the scroll plates during operation of the scroll type unit is not considered critical to the present invention and may take any suitable form sufficient to accomplish the desired result.

Figure 5:
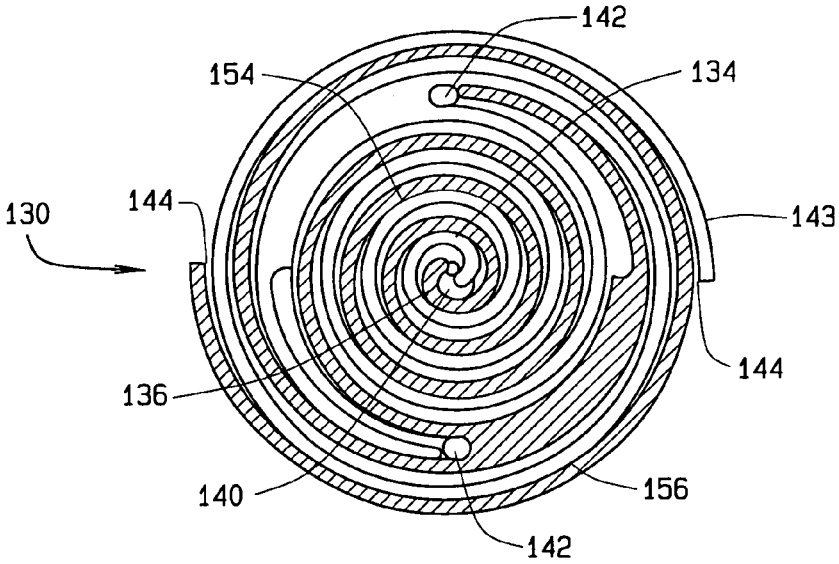
FIG. 5 is a partial sectional view of the scrolls looking in one direction along cut 5-5 of FIGS. 1 through 4, showing a preferred involute wrapping for achieving both compression and expansion on the same scroll.
Figure 6:
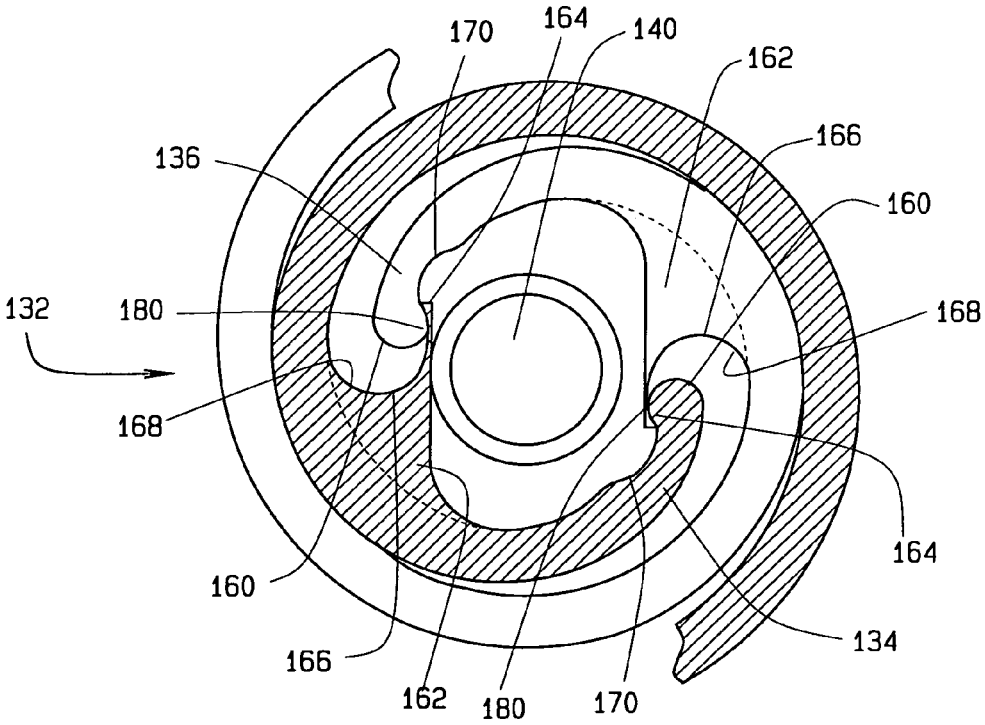
FIG. 6 is a view somewhat similar to FIG. 5, but looking in the opposite direction from FIG. 5 at cut 5-5 of FIGS. 1 through 4 and providing an expanded view of a portion of the inner scroll set of plate pair, which view illustrates an alternate portion configuration, locatable at the ports depicted in FIG. 5, that may be employed to delay the porting so that higher compression/expansion ratios can be achieved with fewer spiral wraps of the scroll.

As best shown in FIGS. 5 and 6, scroll plates 104 and 106 (FIG. 1), which together form a scroll set or scroll plate pair, include on facing sides 130 and 132 thereof interleaved involute scrolls 134 and 136, each of which scrolls 134 and 136 spirals outwardly in one clock direction from central portion 140 of the scroll set to an intermediate spiral point 142 spaced radially intermediately between central portion 140 and the outer periphery 143 of the scroll set, and then spirals outwardly in the opposite clock direction from intermediate spiral point 142 to an outer spiral point 144 near the outer periphery 143 of the scroll set. In the view of FIG. 5, the involute spirals 134 and 136 are shown spiraling outward counter-clockwise from the center portion 140 of the scroll set from central portion 140 to intermediate spiral point 142, and then continuing to spiral outwardly, but in a reverse clockwise direction, from intermediate spiral point 142 to outer spiral point 144.

Such reversal of direction of the spirals 134 and 136 results in two separate sections of the scrolls, one for effecting compression of fluids properly introduced thereinto and one for effecting expansion of fluids properly introduced thereinto. In the construction of FIG. 5 the inner section 154 is designed and intended for effecting expansion and the outer section 156 is designed and intended for effecting compression. For certain conditions, however, the functions could be reversed if it were so desired.

For constructions in which the inner portion is designed to function as an expander and the outer portion is designed to function as a compressor, points 140, 142, and 144 have associated therewith a compressor inlet port at point 144, an expander inlet port at point 140, and a discharge port at points 142, all of which ports typically extend to the left face of the construction shown in FIG. 1, although only expander inlet port is seen in the cross-sectional view of FIG. 1 at location 157.

Typically, in use, expander inlet port will be connected to the outlet from the evaporator of an ORC, compressor inlet port will be connected to the outlet from the evaporator of the traditional air conditioning cycle, and discharge port will be at an intermediate pressure, with part of the flow therefrom going to the condenser for the ORC and part going to the condenser of the air conditioning system.

U.S. Pat. No. 6,050,792, incorporated herein by reference thereto, has previously described how a scroll type device may be constructed to include a scroll set in which the scroll plates have scrolls of two different involute heights in two sections of the same scroll. Such sectional technique can also be utilized in this invention for adjusting the displacement of the expander and compressor sections.

As may be seen from FIG. 5, when the outer section 156 of the scroll is designed to function as a compressor and the inner section 154 is designed to function as an expander, compressor inlet port 144 is provided at the shown outer spiral point 144 and a compressor outlet or port 142 is provided at the shown intermediate spiral point 142. Similarly, an expander inlet or port 140 shown is provided at center 140 and the outlet or port 142 shown at intermediate spiral point 142 is also the expander discharge outlet or port.

Depending upon the uses desired for the single scroll unit 100 and the systems in which it might be employed, ports 140, 142, and 144 may be suitably connected to appropriate sources, vents, or other system connections. In most systems with which such scroll unit is employed, the expander discharge and compressor discharge will typically be at the same pressure, but the scroll unit may be configured to include a seal between the expander and compressor discharges in instances and/or for systems where they may differ. While there is generally no need for any associated switching related to such discharges, the ports could also be suitably controllably switched, if so desired, in order to affect the desired functions of such scroll unit 100.

In such constructions, it is preferable that the spiral involutes have a generally uniform wall thickness t, with the distance between wall mid-points of one wrap of the involute and a succeeding wrap of such involute being considered to be the Involute_Pitch of such involute.

With reference now to FIG. 6, it may be observed that, for involutes having such characteristics, it is possible to delay the porting of the scroll toward the center end of the spiral wraps by rounding the centrally positioned ends of the involutes to form rounded inner ends 160 that have outer radii $r_c$ equal to ½ of the wall thickness t, i.e., $r_c=t/2$.

As the inner sections 154 spiral outwardly towards the intermediate spiral point, when the positions along the spiral sections are displaced 180° about the center, there are formed along the inner sides of each of the spiral wraps a flared mating portion 162 that has an upstream flare portion 164 and a downstream concavity 166 with a mating surface 168 that has a radius $r_M$ of ½[(Involute_Pitch)−t], i.e., $r_M$=[(Involute_Pitch)−t]/2.

As may be observed, such mating surface radius $r_M$ of the spiral of plate 104 will match perfectly with the rounded end 160 on the spiral of spiral plate 106 as the scroll plates 104 and 106 move relative to one another, and such interaction will delay the porting of the scrolls.

Oftentimes it is important to delay the porting of the scrolls so that a higher compression ratio for a compressor, or expansion ration for an expander, can be achieved in a smaller number of spiral wraps. This will allow the unit to be smaller and less costly.

It should be further appreciated that it is possible to delay the porting even more by placing relief areas 170 just outward from the rounded ends 160 on the inner sides of the spirals and by providing complementary fingers 180 at the outer termini of the flared mating portions 162 so that the fingers 180 can complementarily engage the inner sides of the rounded ends 160 and relief areas 170.

Alternative porting of this or similar design can be provided at either or both of points 142 and 140 of FIG. 5.

Those skilled in the art will also appreciate and understand that the involute spirals can be readily sealed with tip seals at locations 190 and 192, as noted in FIG. 1, in acceptable conventional manners and using acceptable conventional materials, including elastomeric sealing materials. U.S. Pat. No. 6,511,308 and U.S. patent applications Ser. Nos. 11/703,585 and 12/930,140, incorporated herein by reference thereto, disclose several examples of acceptable manners and materials, which manners and materials should not be considered or treated as being limiting or exhaustive, however.

With further reference now to FIG. 2, which depicts one preferred alternative embodiment of a scroll type unit 100 according to the present invention, such embodiment includes therewith an optional generator or motor 202 with an associated shaft 204 that extends to be rotatable within bearings 206 within housing 102, and with counterweights 208 disposed along shaft 204. Dependent upon the uses of the unit 100, element 202 may be selected to be either a generator or a motor or a combination motor/generator. When the condition exists where waste heat is available, but air conditioning is not needed, the motor can also act as a generator for production of electricity.

If the unit 100 is to be employed in a system where an excess of waste heat is produced, element 202 may be an auxiliary generator that can be driven from the expander of the unit 100 to generate electricity. Alternatively, element 202 may be a motor that is employed to drive the compressor of the unit 100, such as to provide air conditioning. If so desired, element 202 could a combination motor/generator.

In addition, the embodiment of FIG. 2 includes an auxiliary device 210, which may take many forms, including as an oil pump, fan, turbine, or other desired device, disposed to be driven by an idler shaft 108 of unit 100.

It should also be understood and appreciated that, by closing a valve to the inlet to the expander or inner scroll section of the scroll set, the expander portion can be isolated and will then draw a vacuum and require very little parasitic power. The motor 202 can then be used to power the compressor or outer scroll section of the scroll set independently for cooling or heating (heat pump mode) during times when there is not waste heat available to the ORC.

Likewise, the compressor inlet can be closed off when air conditioning is not needed, but waste heat is available for the ORC. That would draw a vacuum on the compressor or outer scroll section of the scroll set and greatly reduce the, power that it would then draw. In such mode the element 202 would act as a generator and produce electricity.

From the foregoing description and discussion it should be apparent that the invention and the preferred embodiments thereof that have been addressed provide a scroll type device that includes a single pair of scroll plates that are so configured and so interact to provide both compression and expansion functions as the plates eccentrically orbit one another in a given, normal direction, which functions advantageously permit waste heat energy to be used for air conditioning purposes.

While it is generally most beneficial to be able to make use of both the compression and expansion functions, the use of such constructions need not be limited to joint or dual use environments. With appropriate porting, the constructions can also be employed for either compression or expansion purposes without necessarily requiring the use of both.

Additionally, it should be understood and appreciated that reference herein to the invention as forming or being a single unit construction is not intended to limit the use of the invention or embodiments thereof to devices that are totally or physically separate from other elements or components, but, rather is intended to indicate that the invention does not require additional scroll plate pairs beyond the single scroll plate pair whose operation effects both the compression and expansion functions of the invention and to indicate that the invention is considered complete in its single stage form. In such regard, the invention could be readily employed as part of larger or more complex configurations or constructions, such as in multi-staged constructions, which include additional elements or components.

In light of all the foregoing, it should thus be apparent to those skilled in the art that there has been shown and described a scroll type construction of a unique design that incorporates compression and expansion functions into a single unit as the unit normally operates in a single direction. However, it should also be apparent that, within the principles and scope of the invention, many changes are possible and contemplated, including in the details, materials, and arrangements of parts which have been described and illustrated to explain the nature of the invention. Thus, while the foregoing description and discussion addresses certain preferred embodiments or elements of the invention, it should further be understood that concepts of the invention, as based upon the foregoing description and discussion, may be readily incorporated into or employed in other embodiments and constructions without departing from the scope of the invention. Accordingly, the following claims are intended to protect the invention broadly as well as in the specific form shown, and all changes, modifications, variations, and other uses and applications which do not depart from the spirit and scope of the invention are deemed to be covered by the invention, which is limited only by the claims which follow.

What is claimed is:

1. A scroll type device for operating on a fluid introduced there into, comprising, as an operable unit, a housing;

two scroll plates, each having centers, outer limits, and facing sides with spiral projections thereon;

said scroll plates installed within said housing with said facing sides facing one another and with said spiral projections thereon interleaved to form a scroll plate pair;

said scroll plates being operably movable relative to one another in an eccentric orbit;

each of said spiral projections including first and second spiral portions, with said first and second spiral portions forming an inner involute spiral that spirals outwardly from the center in one spiral direction to an intermediate spiral point located intermediately between said center and the outer limit of said scroll plate, and a second spiral portion forming an outer involute spiral that spirals outwardly from said intermediate spiral point in the counter direction from that of said inner involute spiral to an outer spiral point near said outer limit of said scroll plate, the counter direction of the second spiral portion relative to the first spiral portion for effecting compression of any fluid in one of the spiral portions and for effecting expansion of any fluid in the other one of said spiral portions;

said scroll plates and said first and second spiral portions thereon forming a scroll set that includes inner and outer scroll set portions;

said inner scroll set portion having an inlet port associated therewith near the centers of said scroll plates and an outlet port associated therewith near said intermediate spiral points of said scroll plates;

said outer scroll set portion having an inlet port associated therewith near said outer spiral points of said scroll plates and an outlet port associated therewith near said intermediate spiral points of said scroll plates;

said outer scroll set portions operable to function as a scroll compressor during normal eccentric orbital movement of said scroll plates in a given movement direction, and the other said inner scroll set portion operable to function as a scroll expander during said normal eccentric orbital movement of said scroll plates in said same given movement direction;

one of said scroll plates is fixed and the other scroll plate is movable;

a plurality of rotatable idler shafts for controlling the movement of said movable scroll plate relative to said fixed scroll plate, and there being a spacing between said scroll plates;

a thrust bearing for controlling, in cooperation with said idler shafts, the movement of said scroll plates;

each of said idler shafts includes first and second shaft portions having offset axes, said first shaft portion extending through one of said scroll plates and said second shaft portion extending through the other of said scroll plates, whereby eccentric orbital movement of said scroll plates is effected by rotation of said idler shafts;

a set of mounting bearings for each of said idler shafts and wherein said idler shaft is mounted in said set of mounting bearings and extends through said scroll plates;

said plurality of idler shafts includes three idler shafts spaced generally equilaterally about the center of said scroll set;

said inner scroll set portion will operate for expansion and said outer scroll of said portion will operate for compression;

the inlet provided at the outer spiral point is a compressor inlet for fluid, the outlet provided at the intermediate spiral point is a compressor discharge and expander discharge for fluid, and the inlet provided at the center is an expander inlet for fluid; and whereby, as the scroll type device operates in said given movement of direction with said scroll plates moving relative to one another in a given eccentric orbit, one of said inner and outer scroll set portions operates as a scroll expander to expand fluid provided thereto at said inlet port for said scroll set portion and to discharge the expanded fluid at said intermediate outlet port for said scroll set portion, and the other of said inner and outer scroll set portions operates as a scroll compressor to compress fluid provided thereto at said inlet port for said scroll set portion, and to discharge the compressed fluid at the intermediate outlet port for said scroll set portion depending upon the delivery of fluid to either the compression or expansion inlet ports.

2. The scroll type device of claim 1 wherein each of the scroll set portions for the scroll plate pair forming the fixed and orbital scroll plates includes inner ends, the inner ends of each scroll set portion having a rounded configuration having a radius approximately ½ the thickness of each scroll set portion, the inner sides of each spiral near its inner ends having an inwardly flared portion, each of the flared portions having concavities formed therein, and which concavities are formed of a radius greater than the radius of the rounded inner ends of each of the scroll set portions, the rounded end of each scroll set portion fitting within the flared mating portion of the other scroll set portion and capable of eccentric movement therein during operations of the scroll device; and wherein the inner involute spirals located within the flared mating portion of the other inner involute spiral configured to delay porting of the fluid entrance through the proximate inlet port of the scroll type device, and each of the rounded ends of the scroll set portions having a relief area to further delay porting of the scrolls so as to attain higher compression ratio for the compressor action.

3. The scroll type device of claim 1 further including an auxiliary device operable by said idler shafts.

4. The scroll type device of claim 1 including an Oldham ring for controlling positioning and alignment of said scroll plates relative to one another.

5. The scroll type device of claim 1 wherein said scroll type device further includes a motor driven by the one of said inner and outer scroll set portions that operates as a scroll expander to drive the other of said inner and outer scroll set portions that operates as a scroll compressor.

6. The scroll type device of claim 1 wherein said scroll type device further includes a motor driven by the one of said inner and outer scroll set portions that operates as a scroll expander to generate electricity.

7. The scroll type device of claim 1 wherein said inner involute spirals have central ends near the center of said scroll set and said inner involute spirals are configured to delay porting toward the central ends thereof.

8. The scroll type device of claim 1 wherein said inner and outer involute spirals have tips sealed with elastomeric sealing materials.

* * * * *